United States Patent [19]

Holman

[11] Patent Number: 4,809,719

[45] Date of Patent: Mar. 7, 1989

[54] PERMANENT WAVE ROLLER

[76] Inventor: Marie T. Holman, 1808 Broadway, Wabeno, Wis. 54556

[21] Appl. No.: 88,596

[22] Filed: Aug. 24, 1987

[51] Int. Cl.[4] ..... A45D 2/14

[52] U.S. Cl. ..... 132/250; 132/245

[58] Field of Search ..... 132/43 R, 43 A, 44, 132/42 A (U.S. only), 42 R (U.S. only), 40 (U.S. only), 39 (U.S. only), 33 R (U.S. only), 31 R (U.S. only), 33 F (U.S. only), 33 B (U.S. only), 38 R (U.S. only)

[56] References Cited

U.S. PATENT DOCUMENTS

| | | | |
|---|---|---|---|
| 731,861 | 6/1903 | Connell | 132/42 A |
| 2,760,499 | 8/1956 | Taylor | 132/43 R |
| 2,825,344 | 3/1958 | Lenois | 132/42 R |
| 3,590,829 | 7/1971 | Parisi | 132/43 R |
| 3,718,144 | 2/1973 | Jennis | 132/39 |
| 4,577,647 | 3/1986 | Fenster et al. | 132/43 R |
| 4,605,021 | 8/1986 | Hodson et al. | 132/43 R |

FOREIGN PATENT DOCUMENTS

| | | | |
|---|---|---|---|
| 3301592 | 7/1984 | Fed. Rep. of Germany | 132/43 A |
| 2385354 | 12/1978 | France | 132/40 |
| 0022711 | of 1907 | United Kingdom | 132/42 A |

*Primary Examiner*—Gene Mancene
*Assistant Examiner*—Adriene J. Lepiane
*Attorney, Agent, or Firm*—Recka, Joannes & Faller

[57] ABSTRACT

A permanent wave roller comprising an elongated bendable center core, a plurality of discs axially mounted on such core, the discs being spaced apart from each other along the core; the external perimeter of the discs forms a support surface to support an open mesh affixed between the two end pieces; the bendable center core allows the roller to be bent to conform to the shape of a user's head, and the spaces between the discs allow permanent wave solution to pass through the roller, quickly wetting a curl formed with the roller while supporting the curl.

6 Claims, 1 Drawing Sheet

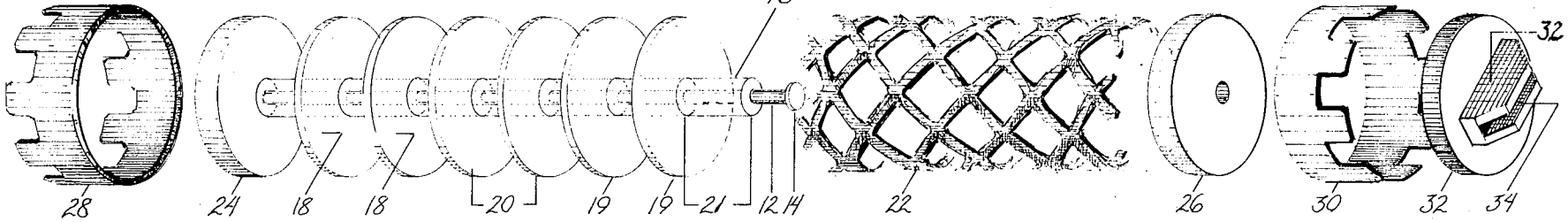
FIG. 1
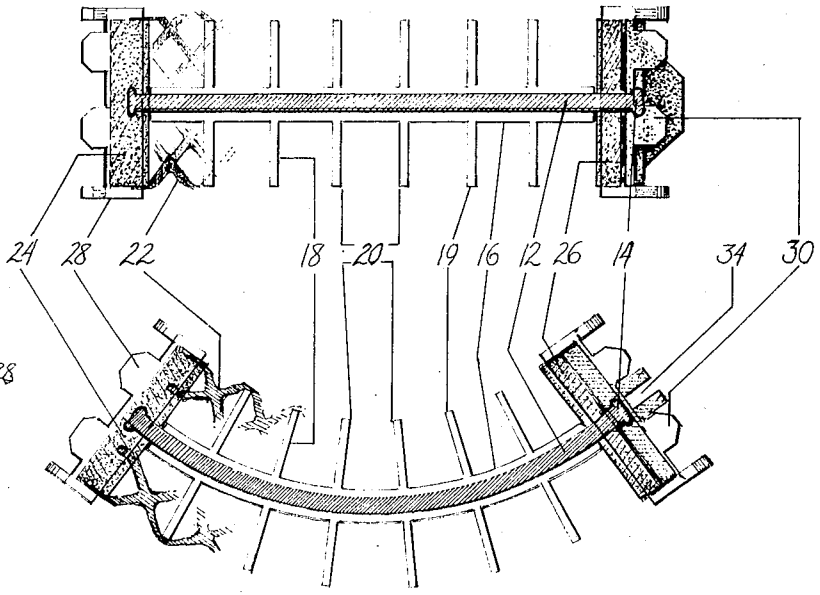
FIG. 2
FIG. 3
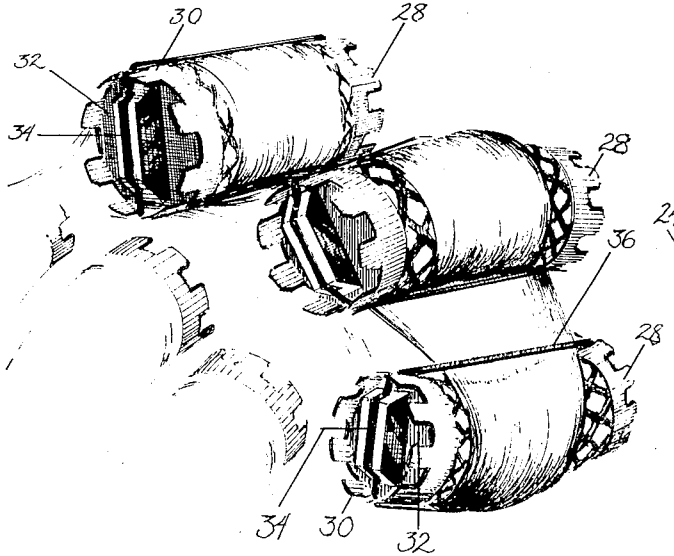
FIG. 4

PERMANENT WAVE ROLLER

BACKGROUND OF THE INVENTION

1. Field of the Invention

The invention is a permanent wave roller used to hold a lock of hair while a permanent wave solution is applied to the lock of hair. The device is used to form a curl which follows the natural contour of the head.

2. Description of the Related Art

Two types of rollers are used for curling hair. One type is the setting roller, typically an open tubular roller, enclosing a coil spring such as is shown in U.S. Pat. No. 3,348,554 and U.S. Pat. No. 3,718,144; another type is the permanent waving roller used in conjunction with chemicals to effect a permanent curl as is shown in U.S. Pat. Nos. 1,921,394; 2,391,284; and 4,349,038.

A bendable permanent wave roller is shown in U.S. Pat. No. 4,540,006.

A hair setting roller is used after hair is shampooed to curl the hair. The curl is not permanent and lasts only until the next time the hair is washed. The function of the open area in the hair setting roller is to allow moisture to evaporate. No chemicals are used with hair setting rollers except perhaps a setting gel or lotion similar to a mousse.

A permanent wave roller is used with a setting or relaxing solution to permanently curl or wave the hair.

In using a permanent wave roller, a square of dry paper is wrapped around the end of a lock of hair; the lock is then rolled around the permanent wave roller, the roller is rolled up to the head and then the roller is fastened to the head by an elastic band and pins.

A setting or relaxing solution is poured over the roller, saturating the lock of hair and inducing curl.

The permanent wave roller is worn for about a half hour depending on the hair type, until the curl takes.

Saturation of a lock of hair tightly wound around a solid permanent wave roller takes a substantial period of time for the solution to pass through the lock of rolled up hair, to saturate each hair in the lock and to saturate the end paper.

The current art, generally rigid, permanent wave roller can be rolled up to the skull only to a line tangent to a point on the curved skull. If the roller is flexible and is bent to follow the natural curve of the skull, the ends of the roller stretch the hair, as the roller attempts to recover its natural shape; it is then uncomfortable to wear because of the pulling of the roller.

The majority of permanent wave rollers are made of plastic because setting or relaxing lotions are corrosive to most metals.

SUMMARY OF THE INVENTION

The invention is a permanent wave roller comprising a bendable center core, a protective coating or sheath over the center core, a plurality of spaced discs mounted along the core, a pair of crenulated end pieces mounted at the ends of the center core, a stretchable mesh covering, mounted over the discs, and a rotatably mounted elastic retaining device, mounted on one end of the roller.

Crenulated is defined as having minutely notched projections. An elastic band stretched lengthwise of the roller is affixed to the notches on the end pieces to retain the lock of hair.

A lock of hair is wound around the roller, the roller with its entrapped lock of hair is rolled up to the head and the device is then bent to conform to the shape of the head. An elastic is fastened over opposite crenulated end pieces to retain the roller with its rolled up lock of hair, up against the skull.

Setting or relaxing solution is poured or applied to the lock of hair. Because of the openings between the discs, the solution quickly penetrates and saturates the lock.

The curl formed with this device forms in a radius following the natural contours of the head, rather than forming on a line tangent to the curve of the head.

The traditional non-bendable three inch roller creates a one-half inch corner at each end of the roller. In that half-inch, the hair is not curled close to the head. A curl is formed that does not conform to the natural shape of the head. As hair continues to grow, the one-half inch of uncurled hair at each end of the roller grows out to one inch and results in an uneven curl distribution. A curl formed with the bendable roller lasts a month longer, because hair growth and movement of the curl away from the head with that growth, follows the natural curve of the head.

The bendable roller curving around the head, lessens interference with other rollers placed on the head, which occurs when using straight non-bendable rollers.

It is an object of the invention to form a curl, which rather than forming on a line tangent to a point on the head, forms on a curved line, the curve of the line being the natural contour of the head at the area where the roller is affixed.

It is an object of the invention to produce a permanent wave roller that is open to free flow of setting or relaxing lotion. Such free flow, lessens the time necessary to saturate the lock of hair and to effect a curl.

It is an object of the invention to support the lock of hair as the solution is applied so a uniform curl is applied.

It is an object of the invention to produce a roller that is bendable to conform to the curve of the skull, without any spring back of the roller.

It is an object of the invention to produce a roller that is bendable by hand but resistant to further bending by the force applied by the elastic band used to retain the roller.

It is an object of the invention to produce a roller having crenulated end pieces to hold an elastic retainer. It is also an object of the invention to produce a roller having a rotating elastic holding end piece so the roller can be affixed with one hand, allowing the other hand to hold the roller snug against the head during fastening.

BRIEF DESCRIPTION OF THE DRAWING

FIG. 1 is a disassembly view of the permanent wave roller.

FIG. 2 is a section view of the assembled roller with the mesh covering partly removed.

FIG. 3 is a section view of the assembled roller, bent to conform to the shape of the skull, with the mesh covering partly removed.

FIG. 4 is a view of the rollers as placed on a persons head.

DESCRIPTION OF THE PREFERRED EMBODIMENT

The permanent wave roller as shown in FIG. 1, comprises a bendable center core 12; swaged end piece 14 is formed on the end of center core 12; core protective coating 16 used to prevent the chemically active hair setting or relaxing solution from contacting the bendable core; a plurality of support discs 18 spaced along the core; discs 18 provide a support surface 19; discs 18 can be solid circular discs with a center hole or open discs with a center hole analogous to a spoked wheel; disc spacing 20 between discs 18 allows hair setting or relaxing solution to pass between the discs 18 while stretchable mesh 22 supported by support surface 19 retains and supports a lock of hair; stretchable mesh 22 is retained on the roller by being frictionally held between the outside perimeter of mesh retaining discs 24 and 26 and crenulated end pieces 28 and 30; rotatable elastic retainer 32 is pivotably mounted between mesh retaining disc 26 and crenulated end piece 30; rotatable end piece 32 pivots on swaged end piece 14, as is best shown in FIGS. 2 and 3; the rotatable elastic retainer 32 is formed with a U-shaped slot 34; slot 34 is narrower at the top opening than at the bottom of slot 34; a stretched elastic band 36 will fit in slot 34, but when not stretched, will remain in slot 34.

FIG. 2 is a section through a roller. Pivotable end piece 32 is shown at the right; end piece 32 pivots on swaged end piece 14.

FIG. 3 shows a roller bent to conform to the radius of the head. Openings or disc spacing 20 allow setting solution to quickly saturate the curl.

FIG. 4 shows rollers on a person's head. Elastic 36 is shown passing out of slot 34 across both sides of the lock of hair and retained by the slots in the crenulated end piece 30.

BEST METHOD

The permanent wave rollers made in conformity to this invention are from two to five inches long measured from the outside of the crenulated end pieces. Longer rollers are contemplated. Diameter of the rollers varies from one quarter inch to one inch.

In a prototype permanent wave roller three and one-half inches in length, the bendable center core is made of a rod of annealed copper approximately one eighth inch in diameter. The center bendable core may be made of other materials such as hard drawn copper, aluminium or of an aluminum copper alloy. Other bendable materials known in the art may be used.

Optimally the material used in the bendable center core and the diameter of the bendable center core is defined by these constraints;

(a) the core must be easily bendable and straightenable by hand to conform to the shape of the skull;

(b) be resistant to fatigue failure caused by repeated bending and straightening;

(c) after being bent to conform to the shape of the skull the core must be resistant to further bending caused by the force applied by the retaining elastic used to hold the device on the head;

(d) have little or no spring back when bent;

(e) be inexpensive; and (f) be non-reactive to the chemicals used in hair setting or relaxing solution.

The materials used in the prototype is covered by a plastic sheath because it is not non-reactive. A non-reactive material would eliminate the need for the center cover protective covering and the center core could be ridged to provide disc spacing.

In the prototype, the covering of the center core is by short cylindrical spacers of a plastic sheathing material.

Assembly of the prototype comprises cutting the core 12, swaging an end piece 14 on the core, sliding the rotatable elastic retainer 32 on to the core; a hole in the center of retainer 32 allows it to be slid on to the core 12; end piece 14 prevents retainer 32 from falling off and provides a surface on which the retainer 32 revolves; this can best be seen in FIGS. 2 and 3; mesh retaining disc 26 which has a hole formed through its center, is slid on to core 12; in FIG. 1, spacer 21 is shown also as protective coating 16; after disc 26 and spacer 21 are slid onto the core, a support disc 18 is slid onto the core 12; a disc spacing 20, of five sixteenths of an inch is used in the prototype; after all support discs 18 and spacers 21 are inserted, mesh retaining disc 24 is placed on the core 12; open polyethylene mesh 22 with square or diamond shaped openings, formed in a tubular shape, is slid over the discs 24, 18, and 26; mesh 22 is retained on the assembled roller between the outside perimeter of discs 24 and 26 and the inside perimeter of crenulated end pieces 28 and 30; the mesh 22 bends to conform to the shape of the bent roller; the discs 24, 18 and 26 in the prototype are seven eighths of an inch in diameter and have a center hole one eighth of an inch in diameter.

In the prototype ten slots are formed in each of the crenulated end pieces.

In one proposed production model, the core protective covering 16 or 21, the discs 18 and discs 24 and 26 are formed as one piece of thermoplastic with an open center core. In an alternate design the center core is covered completely with a dipped or heat shrunk thermoplastic coating, having circular ridges formed therein of decreasing radius from the swaged end 14, and discs having increasingly smaller center holes are assembled onto core 12, the distance between ridges being the desired spacing of the discs.

An alternate mesh used in a prototype is neoprene mesh.

The discs 24, 18, and 26, and crenulated end pieces 28 and 30, in the prototype were made of ABS plastic and acrylic plastic. The spacers 21 in the prototype were made of nylon.

The device can be used without bending if a user so chooses. If used without bending, the device decreases the time necessary to saturate a lock of hair by allowing free flow of setting solution.

I claim:

1. A permanent wave hair setting roller comprising:

an elongated center core;

a plurality of discs mounted axially along the length of such elongated center core, such discs being spaced apart from each other along the length of the elongated center core;

a support surface formed by the external perimeter of the discs;

a first end piece mounted at one end of the elongated center core;

a second end piece mounted at the other end of the elongated center core;

an open mesh mounted between the two end pieces, such mesh extending over and supported by the support surface formed by the external perimeter of the discs, whereby permanent wave solution applied to the roller passes through the mesh and through the cylindrical spaces formed between the discs, quickly wetting all surfaces of a curl.

2. A permanent wave roller as in claim 1 wherein said elongated center core further comprises:

a bendable rod, such rod being made of a material resistant to failure from repeated bending.

3. A permanent wave roller as in claim 2 wherein such material is selected from the group consisting of copper, aluminum and aluminum copper alloy.

4. A permanent wave roller as in claim 3 wherein the thickness of the elongated center core is established by the force needed to easily bend such roller to conform to the shape of the skull by hand, while being resistant to further bending, caused by force of an elastic band used to retain the roller to a user's head.

5. A permanent wave, hair setting roller for forming a continuous radius curl comprising:

an elongated bendable center core;

a protective covering encasing such elongated bendable center core;

a plurality of support discs mounted axially on such elongated center core, such discs being spaced apart from each other along such elongated bendable center core, the external perimeter of such support discs forming a support surface, spaced outwardly from the elongated bendable center core; the spaces between the discs permitting free flow of setting lotion applied to the roller;

a first crenulated end piece mounted at one end of the elongated bendable center core;

a second crenulated end piece mounted at the other end of the elongated bendable center core;

an open mesh affixed between each of the crenulated end pieces, extending over and supported by the annular cylindrical support surface formed by the support discs.

6. The device as in claim 5 further comprising an elastic band holder, pivotally mounted to one of the crenulated end pieces, pivotal in an axis parallel to the longitudinal axis of the bendable center core.

* * * * *